United States Patent [19]

Waller

[11] Patent Number: 4,875,592

[45] Date of Patent: Oct. 24, 1989

[54] DRYING RACK AND RECEPTACLE FOR TOWELS AND WASH CLOTHS

[76] Inventor: George W. Waller, Rte. 13, 190 Strickland Rd., Alpharetta, Ga. 30201

[21] Appl. No.: 259,335

[22] Filed: Oct. 18, 1988

[51] Int. Cl.[4] ..... A47F 5/08

[52] U.S. Cl. ..... 211/88; 211/6; 211/59.2; 34/151; 34/239

[58] Field of Search ..... 211/88, 6, 59.2, 16; 312/229, 37; 206/438, 233; D6/553, 522, 515; 34/239, 151

[56] References Cited

U.S. PATENT DOCUMENTS

| | | | |
|---|---|---|---|
| D. 255,852 | 7/1980 | Fogarty | D6/515 |
| 1,248,984 | 12/1917 | Ammann | 211/6 |
| 1,524,704 | 2/1925 | Fore | 211/88 |
| 1,578,614 | 3/1926 | Sullivan | 211/6 |
| 1,863,471 | 6/1932 | Colaizzi | 211/88 |
| 2,815,585 | 12/1957 | Thompson | 34/239 X |
| 3,684,102 | 8/1972 | Colter | 211/88 |
| 4,117,309 | 9/1978 | Cayley | 34/151 X |
| 4,799,744 | 1/1989 | Toy | 312/229 |

FOREIGN PATENT DOCUMENTS

| | | | |
|---|---|---|---|
| 446685 | 2/1948 | Canada | 211/59.2 |

*Primary Examiner*—Ramon S. Britts
*Assistant Examiner*—David G. Kolman
*Attorney, Agent, or Firm*—Laurence R. Brown; Alfred J. Mangels

[57] ABSTRACT

A drying rack for drying wet cloths, such as towels and washcloths. A substantially rectangular enclosure is provided having a pair of openings that are laterally spaced from each other, and a curved drying surface extends between the openings. The enclosure includes a drip pan for catching and collecting water that drips from wet cloths that lie on the drying surface. The drip pan is removable from the enclosure for discarding the collected water, and a screen is positioned within the enclosure between the drying surface and the drip pan to prevent cloths from falling into the drip pan, while permitting water to pass therethrough. In one form of the invention a towel dispenser is provided on one side of the enclosure, and the towel dispenser is adapted to receive and contain a stack of dry cloths ready for use. In another form of the invention a removable used cloth enclosure is provided that can be selectively attached next to and removed from attachment relative to the clean towel holder.

16 Claims, 4 Drawing Sheets

FIG. 1
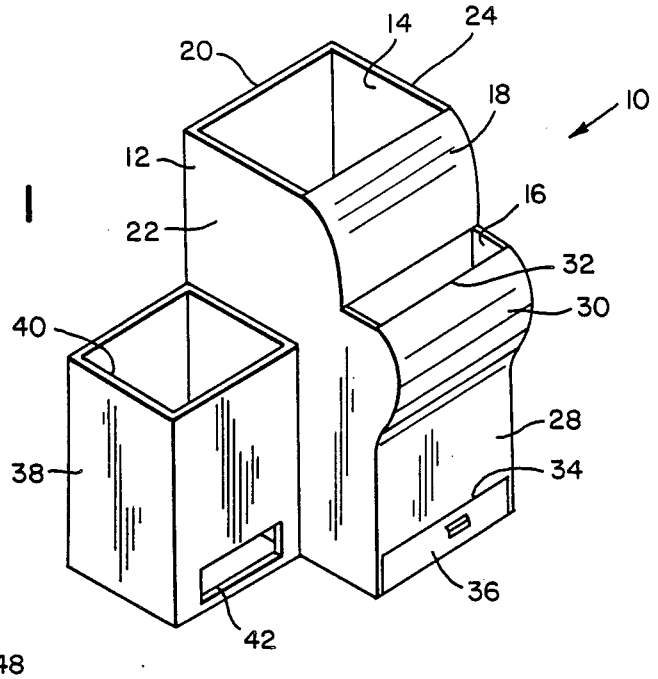
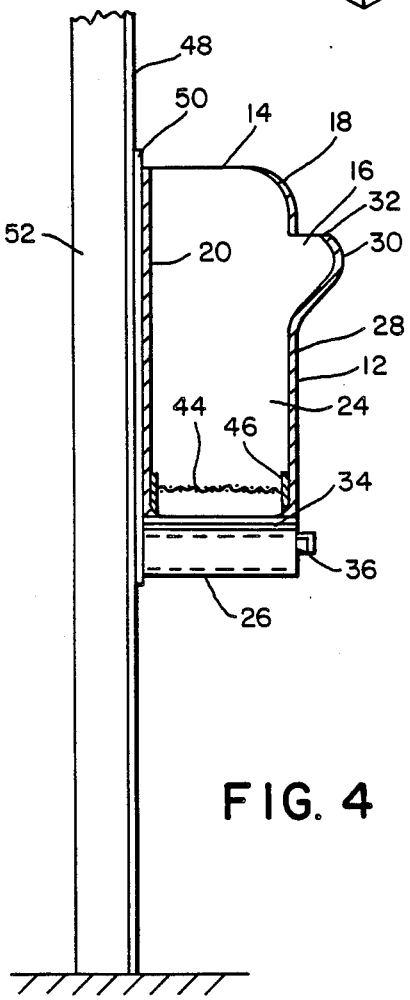
FIG. 4
FIG. 3
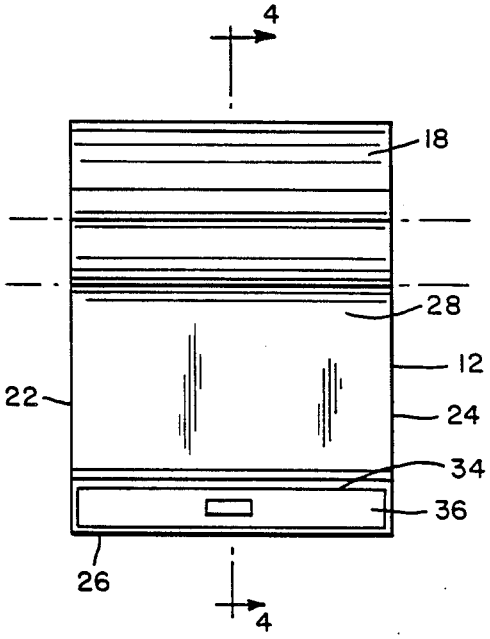

DRYING RACK AND RECEPTACLE FOR TOWELS AND WASH CLOTHS

BACKGROUND OF THE INVENTION

1. Field of the Invention

This invention relates to a drying rack for towels and wash cloths, and more particularly to a drying rack that includes an enclosure that has a drying surface for hand towels and wash cloths, and that includes a collecting pan to collect and retain water that drips from the drying cloth.

2. Description of the Related Art

In recent years there has been a significant growth in the use of disposable hand towels made of cellulosic fibers and the like. Such towels are typically sold in roll form, although they can also be in stacks of folded towels, and they are significantly more costly to use than cloth towels that can be dried and reused. Oftentimes disposable towels are made from wood fibers, with the resultant increased destruction of trees and other forest growth to accommodate the demand for such products.

Accordingly, it is an object of the present invention to provide a convenient drying rack for cloth hand towels or wash cloths to permit drying and reuse, and thereby avoid the increased costs associated with the use of disposable towels.

It is also an object of the present invention to provide a towel drying rack that can be combined with a cloth towel dispenser to permit a used and wetted cloth to dry and to provide a collection pan for water that drips from the cloth.

SUMMARY OF THE INVENTION

Briefly stated, in accordance with one aspect of the present invention, a drying rack is provided for wet cloths, such as towels and washcloths. The rack includes an enclosure having a pair of spaced, generally rectangular openings, and a convexly curved drying surface that extends between the openings and onto which a wet cloth can be placed for drying purposes. A water collection device is positioned within the enclosure for catching and collecting water that drips from wet cloths that lie on the drying surface.

In accordance with another aspect of the present invention, a drying rack is provided in conjunction with a towel dispenser for dispensing cloths that can be provided either as hand towels or as wash cloths.

BRIEF DESCRIPTION OF THE DRAWINGS

FIG. 1 is a perspective view showing a drying rack in accordance with the present invention, and a hand towel or wash cloth dispenser positioned to one side thereof.

FIG. 3 is a front view of the drying rack shown in FIG. 1.

FIG. 4 is a side elevational view, partially in section, taken along the line 4—4 of FIG. 3, and showing a drying rack in accordance with the present invention secured in position on the surface of a wall.

DESCRIPTION OF THE PREFERRED EMBODIMENTS

Figure 2:
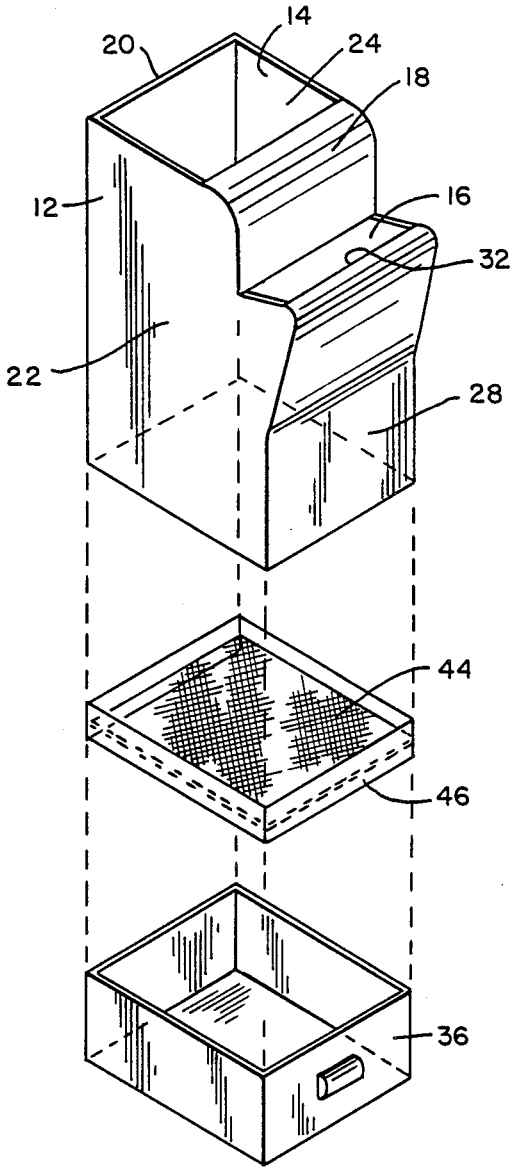
FIG. 2 is an exploded perspective view of the drying rack shown in FIG. 1.

Referring now to the drawings, and particularly to FIG. 1 thereof, there is shown a drying rack 10 in accordance with the present invention. Drying rack 10 is in the form of a generally rectangular enclosure 12, which, in the arrangement shown, has a longitudinal axis extending in a generally vertical direction, and includes two upwardly facing openings 14, 16 that are spaced from each other both in a longitudinal direction of enclosure 12 and in a transverse direction. Openings 14, 16 are of generally rectangular configuration, are positioned at different elevations along the longitudinal axis of the enclosure, and lie in respective parallel planes that are substantially perpendicular to the longitudinal axis of enclosure 12. Extending between the respective openings 14, 16 is a convexly curved drying surface 18 onto which wet hand towels or wash cloths can be draped for drying.

Enclosure 12 includes a rear wall 20 and two spaced, substantially parallel side walls 22, 24. As best seen in FIGS. 3 and 4, enclosure 12 also includes a bottom wall 26, and a front wall 28 that is substantially parallel with rear wall 20, and that extends longitudinally only part way from bottom wall 26 toward opening 14 in a generally upward direction. Front wall 28 includes a convex, outwardly extending panel 30 that curves inwardly toward rear wall 20 and terminates at the outermost edge 32 of opening 16. Front wall 28 includes a rectangular opening 34 to slidably receive a drawer-like drip pan 36 that is slidably supported by bottom wall 26 of enclosure 12 and will be described in more detail hereinafter.

A towel dispenser 38 is provided adjacent sidewall 22 of enclosure 12 and includes an upwardly facing opening 40. Dispenser 38 is adapted to receive a stack of folded hand towels or wash cloths (not shown). Dispenser 38 is of generally rectangular cross-section, and includes a dispensing opening 42 adjacent the bottom wall thereof, to permit withdrawal of dry cloths one-by-one.

As best seen in FIG. 2, positioned within enclosure 12, and at an elevation between the uppermost edge of opening 34 and the upwardly facing opening 16 is a screen 44 carried within a rectangular frame 46 that is adapted to fit within the interior of enclosure 12 above drip pan 36. Screen 44 can be a woven mesh or a perforated plate, and has a plurality of openings to permit water to pass therethrough, but to catch and retain towels or washcloths that are deposited in enclosure 12 after use.

Drip pan 36 can be in the form of a slidable drawer, as shown, for receiving and collecting water, as will hereinafter be explained, and is preferably of rectangular configuration, although other shapes can also be used, if desired.

Drying rack 10, when in use, is preferably carried on and supported by a wall surface 48, as illustrated in FIG. 4. If desired, enclosure 12 can include suitable mounting means, of any type known to those skilled in the art, to mount the enclosure to the wall. Alternatively, if desired, enclosure 12 can be suitably mounted on a mounting plate 50, which is, in turn, secured to wall surface 48 or to stud 52.

In use, drying rack 10 is preferably positioned near a sink or wash stand, so that when one requires a towel or wash cloth, it can be manually withdrawn from towel dispenser 38. After use, the wet towel or washcloth is draped over drying surface 18 so that it is in substantially flat form to expose more surface area for more rapid drying. Any excess water that drips from the cloth falls either through the larger 14 or the smaller 16 of the upwardly facing openings in enclosure 12, through screen 44, to drip pan 36 where it is collected. When a sufficient quantity of water has been collected and drip pan 36 is almost full, it is withdrawn from enclosure 12 and the water is discarded. The drip pan is then reinserted in the enclosure for further use.

If a cloth or towel is badly soiled, a user can drop it through opening 14 so that it falls into enclosure 12 and rests on screen 44. When a number of such cloths or towels have been deposited inside the enclosure they can be removed therefrom for washing, refolding, and reinsertion into dispenser 38 for reuse.

In addition to drying surface 18, outwardly extending panel 30 can also serve as a second drying surface for a second cloth or towel, to permit two cloths or towels to dry simultaneously. Drying rack 10 and the several parts thereof can be made of metal or of plastic, as will be appreciated by those skilled in the art.

Figure 6:
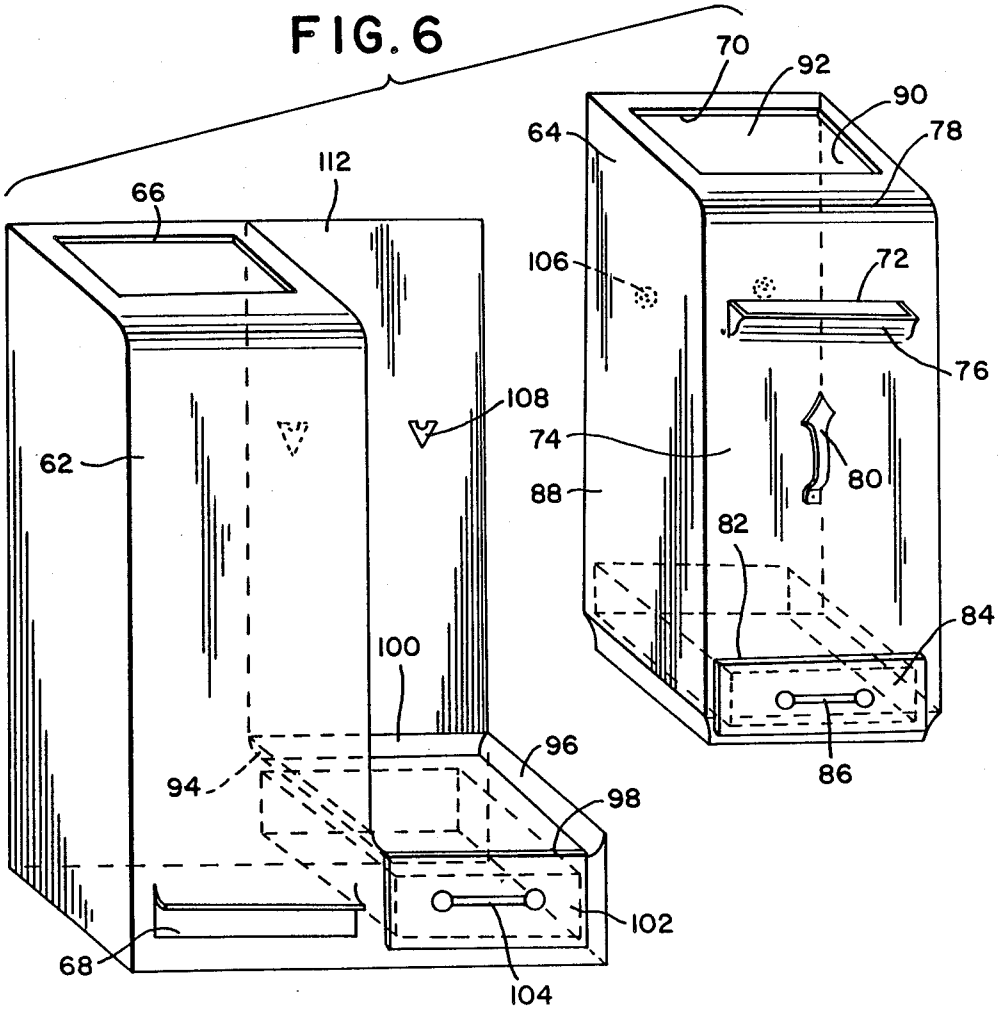
FIG. 6 is an exploded view of the embodiment shown in FIG. 5.
Figure 5:
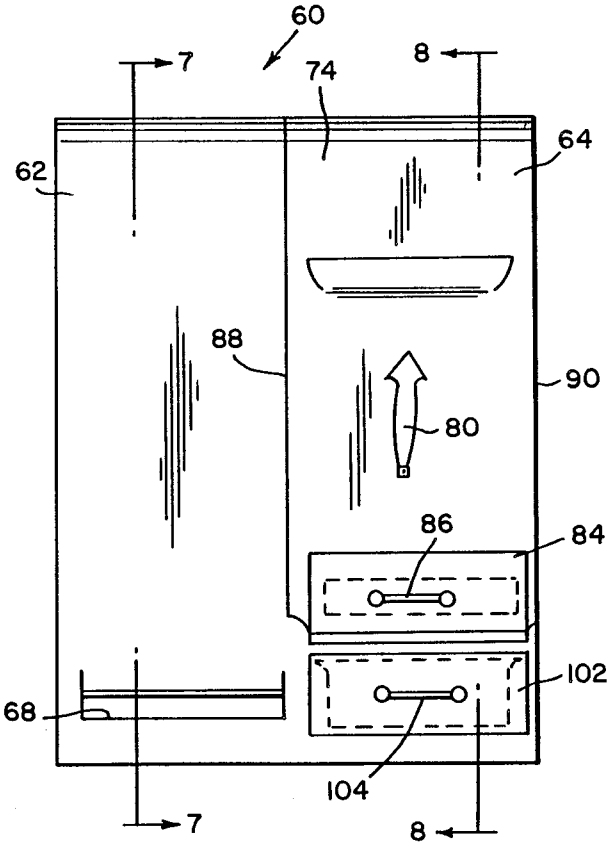
FIG. 5 is a front elevational view of another embodiment of the present invention.

Another embodiment of the present invention is illustrated in FIGS. 5 through 9, which show a drying rack and towel holder assembly 60 that includes two side-by-side enclosures, a clean towel enclosure 62 and a used towel enclosure 64. As best seen in FIGS. 5 and 6, each of enclosures 62 and 64 is of generally rectangular cross section and has a longitudinal axis that extends in a substantial vertical direction. Clean towel enclosure 62 includes a first opening 66 at the top thereof to permit the insertion therein of clean towels, and a second opening 68 in the form of a generally rectangular, elongated dispensing opening to permit the removal of a clean towel therefrom.

Used towel enclosure 64 is positioned next to clean towel closure 62 and is generally similar in structure and configuration to that of the clean towel enclosure, except that the longitudinal length is less. Additionally, used towel enclosure 64 includes a first opening 70 of generally rectangular form positioned in the uppermost surface thereof to permit used towels to be deposited therein. A second generally rectangular opening 72 is defined in front panel 74 thereof by an outwardly extending, inclined lip 76, that defines an upwardly facing, generally rectangular drip-collecting opening. Positioned above drip-collecting opening 72 and extending upwardly and inwardly from front panel 74 toward first opening 70 is a convexly curved drying surface 78 on which a wet towel can be placed in flat, opened condition for drying. Positioned below drip-collecting opening 72 is a carrying handle 80 to permit removal of and carrying of used towel enclosure 64 as will be hereinafter explained.

Adjacent the lowermost portion of front panel 74 of used towel enclosure 64 is a generally rectangular opening 82 to receive a removable screen-containing drawer 84 that is selectively slidable in and out of opening 82 by means of a handle 86. Drawer 84 includes a screen (not shown) similar to screen 44 in the embodiment illustrated in FIGS. 1 through 4, except that in the alternate embodiment the screen is removable by removing drawer 84.

The side walls 88, 90, front wall 74, and rear wall 92 of used towel enclosure 64 each taper inwardly toward the interior of enclosure 64 at a point below drawer 84, and are so arranged that they fit within corresponding upwardly and outwardly tapered panels 94, 96, 98, and 100, respectively, that are provided adjacent the lowermost portion of clean towel enclosure 62 at a point spaced laterally from the longitudinal axis thereof, the respective tapered panels 94 through 100 being positioned to receive the corresponding tapered panels at the lowermost portion of used towel enclosure 64. Below tapered panels 94 through 100 a drawer 102 is provided in the form of a removable water-collecting pan that includes a handle 104. Drawer 102 is similar to drip pan 36 in the embodiment illustrated in FIGS. 1 through 4.

Figure 9:
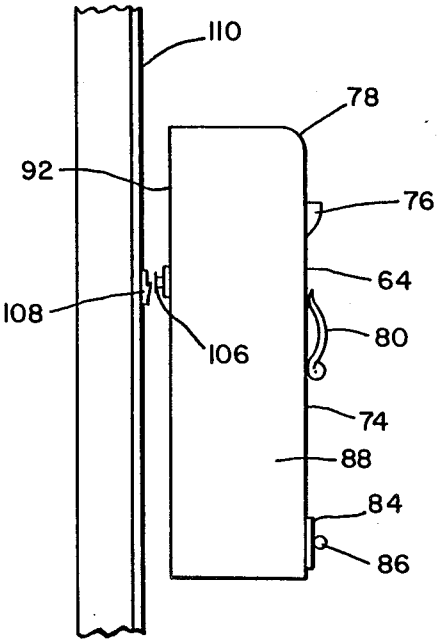
FIG. 9 is side view of the used towel enclosure shown in FIGS. 5 and 6 showing one form of surface or wall attachment arrangement.
Figure 8:
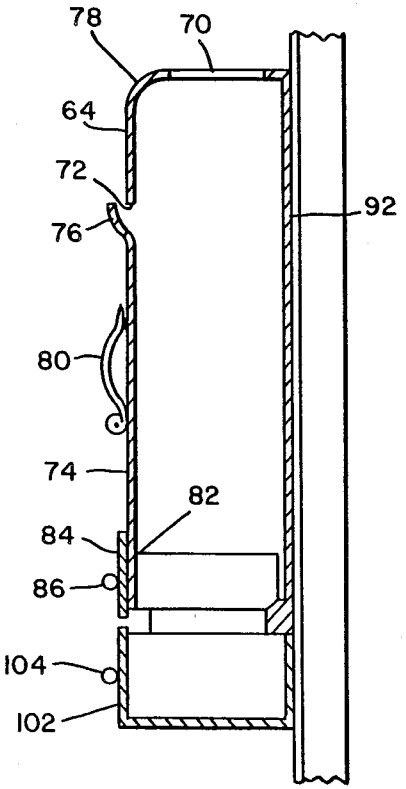
FIG. 8 is a cross-sectional view taken along the line 8—8 of FIG. 5.
Figure 7:
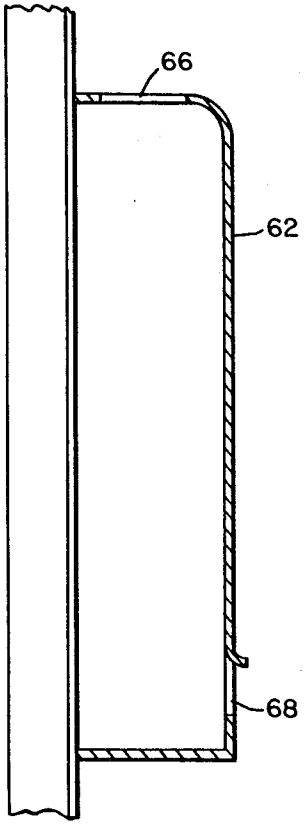
FIG. 7 is a cross-sectional view taken along the line 7—7 of FIG. 5.

As seen in FIGS. 6 and 9, used towel enclosure 64 is separable from the clean towel enclosure, and is retained in position by a pair of laterally spaced, outwardly extending buttons 106 provided on the rearmost surface of rear wall 92 of used towel enclosure 64. Buttons 106 are adapted to engage with outwardly extending, U-shaped support lips 108 that suitably can be provided on wall surface 110. As will be apparent to those skilled in the art, other types of mounting arrangements can also be provided to permit removal and reapplication of the used towel enclosure, and the button and support lip structure shown is for purposes of illustration only. Further, the mounting arrangements can be provided to mount the used towel enclosure directly to a wall surface or, alternatively, the clean towel enclosure can include a laterally extending back plate 112 to which the used towel enclosure can be mounted. Back plate 112 can be suitably mounted to a wall surface, as will be appreciated by those skilled in the art.

The embodiment of FIGS. 5 through 9 functions in substantially the same way as the embodiment shown in FIGS. 1 through 4, except that it provides the additional benefit of removability of the used towel enclosure for further convenience. Also, the separate drip pan 102 reduces the weight of used towel enclosure 64 for ease of carrying. Finally, the tapered lower panels of the used towel enclosure and the corresponding tapered panels immediately above the drip pan serve to funnel water into the drip pan.

It will be recognized that the present invention provides a convenient drying rack for reuseable hand towels and wash cloths, which are considerably less expensive in long term use than are disposable cloths or towels.

Although particular embodiments of the present invention have been illustrated and described, it will be apparent to those skilled in the art that various changes and modifications can be made without departing from the spirit of the invention. Accordingly, it is intended to encompass within the appended claims all such changes and modifications that fall within the scope of the present invention.

What is claimed is:

1. A drying rack for wet cloths such as towels and wash cloths, said rack comprising:

(a) a first enclosure having a front wall, a rear wall, and a pair of opposed side walls, said enclosure including a pair of axially spaced, substantially horizontally disposed enclosure openings;

(b) a convexly curved, generally upwardly facing drying surface positioned between the openings of the enclosure for supporting a wet cloth for drying said curved drying surface extending between said side walls with the lateral edges of said drying surface being coextensive with the adjacent edges of said side walls, said drying surface further defining a portion of the front wall of said enclosure between said openings, thereby providing a relatively large area for said surface; and (c) water collection means positioned below the drying surface for catching and collecting water that drips from wet cloths lying on the drying surface, said water collection means being in the form of a drip container that is below said openings and is laterally slidably movable relative to said enclosure.

2. A drying rack in accordance with claim 1, wherein the openings in the enclosure are of generally rectangular configuration.

3. A drying rack in accordance with claim 1, wherein the openings in the enclosure are each of a different size.

4. A drying rack in accordance with claim 1, wherein the openings include a first opening, and a second opening spaced laterally outwardly of the first opening.

5. A drying rack in accordance with claim 1 including mounting means carried by the enclosure for mounting the drying rack on a substantially vertical wall surface.

6. A drying rack in accordance with claim 5, wherein the mounting means includes a mounting plate carried by the enclosure and to which the enclosure is secured.

7. A drying rack in accordance with claim 1, wherein the water collection means is said carried within and is removable from the enclosure.

8. A drying rack in accordance with claim 7, wherein the water collection means is a drip pan that is slidable laterally into and out of the enclosure.

9. A drying rack in accordance with claim 8, wherein the enclosure includes a lateral opening and the drip pan is a substantially rectangular drawer that is slidable into and out of the lateral opening.

10. A drying rack in accordance with claim 1 including screen means carried within the enclosure between the drying surface and the water collection means, the screen means permitting water to pass therethrough to the water collection means but preventing cloths from falling into the water collection means.

11. A drying rack in accordance with claim 10, wherein the water collection means is removable from the enclosure.

12. A drying rack in accordance with claim 1, including dry towel dispensing means supported against a side of the enclosure for storing dry cloths in a condition ready for use.

13. A drying rack in accordance with claim 1, wherein the enclosure includes a second convexly curved, generally upwardly facing drying surface that is spaced from the first drying surface.

14. A drying rack in accordance with claim 1, including a second enclosure adjacent the first enclosure for storing a supply of clean towels or washcloths, the first enclosure adapted to be removably positioned adjacent the second enclosure for receiving used towels or washcloths, wherein the water collection means includes a drip container positioned below the first enclosure for collecting water that drips from a towel or washcloth; and separator means having through apertures and carried by the first enclosure for separating used towels or washcloths from the drip container.

15. A holder in accordance with claim 14 wherein the drip container forms part of and is received in the second enclosure.

16. A holder in accordance with claim 15 wherein the drip container is removable from the second enclosure.

* * * * *